US005456274A

United States Patent [19]

Selbee et al.

[11] Patent Number: 5,456,274

[45] Date of Patent: Oct. 10, 1995

[54] HAIR BAND WITH REMOVABLE COVER

[76] Inventors: Kathie Selbee, 2816 Scottsdown Road, Kelowna, British Columbia, Canada, V4T 1J3; Laurie Kutzner, 2786 Capri Road, Kelowna, British Columbia, Canada, V1Z 3E6

[21] Appl. No.: 175,105

[22] Filed: Dec. 29, 1993

[51] Int. Cl.[6] ..... A45D 8/12

[52] U.S. Cl. ..... 132/275; 2/174

[58] Field of Search ..... 132/212, 275, 132/273; 2/174, 181, 207, DIG. 11, 338

[56] References Cited

U.S. PATENT DOCUMENTS

| | | | |
|---|---|---|---|
| D. 205,576 | 8/1966 | Day | D86/10 |
| D. 315,036 | 2/1991 | Leopold | D28/41 |
| 1,652,462 | 12/1927 | Stephens | 132/273 |
| 1,692,719 | 11/1928 | Busey | 132/273 |
| 3,000,384 | 9/1961 | Piers, Jr. | 132/46 |
| 3,211,160 | 10/1965 | Miller | 132/47 |
| 3,858,590 | 1/1975 | Lowery | 132/275 |
| 4,481,681 | 11/1984 | Hankin | 2/181 |
| 4,656,671 | 4/1987 | Manges | 2/174 |
| 5,230,355 | 7/1993 | Weingrod | 132/275 |

FOREIGN PATENT DOCUMENTS

| | | | |
|---|---|---|---|
| 1217287 | 5/1960 | France | 132/275 |
| 25633 | 9/1902 | Switzerland . | |

*Primary Examiner*—John G. Weiss

*Attorney, Agent, or Firm*—Baker, Maxham, Jester & Meador

[57] ABSTRACT

A removable cover for a hair band has a fabric tube with first and second ends, the fabric tube having a longitudinally elasticized seam between the first and second ends whereby the cover is removably mountable on the hair band by sliding the fabric tube over the hair band so as to place the seam along an inside surface of the hair band.

6 Claims, 2 Drawing Sheets

HAIR BAND WITH REMOVABLE COVER

FIELD OF THE INVENTION

This invention relates to the field of horse shoe shaped hair bands or hair dressing articles whose primary function is to keep hair in place so that hair will not fall into the face of a person, and in particular to a device for ornamentally decorating the hair band.

BACKGROUND OF THE INVENTION

There exist many hair band articles and many hair dressing articles in the prior art for holding a user's hair in place. It is often desirable that these hair bands or hair dressing articles be decorated or otherwise ornamented for aesthetic appeal.

Applicant is aware of three prior art hair bands having differing forms of decorative ornamentation. U.S. Pat. No. 1,652,462 issued Dec. 13, 1927 to Stephens for a hair Dressing Article. U.S. Pat. No. 3,211,160 issued Oct. 12, 1965 to Miller for a Hair Band With Detachable Cover. French Patent No. 1,217,287 issued to Pochet on May 3, 1960 for what the Applicant believes to be a Hair Band And Decorative Cover.

Stephens teaches a wire form hair band having ornamentation formed of a fabric envelope. The fabric envelope is held in place by the width spacing of the wire form and the length of the wire form so as to tighten the envelope on the form. Also disclosed is the use of a flexible band instead of a wire form within the casing or cover. Stephens does not teach nor suggest making the fabric envelope removable, in that manner to enable changing the ornamentation on the hair band. Rather, what is taught is adding rosettes or other ornamental jewellery by sewing through the cover, and in the case of the flexible flat band, sewing through perforations in the band.

Miller teaches a flexible hair band having a detachable cover secured by releasable fasteners. What is disclosed is an ornamental cover which wraps around the upper surface of the hair band and attaches to the hair band at either end of the hair band and at the apex of the hair band. The hair band is of the conventional horse shoe shape type. In particular Miller relies on snap fasteners or boot-like or equivalent pockets at the ends of ornamental strips to hold ornamental strips in place over the upper surface of the horse shoe shaped hair band.

The Poget teaching merely illustrates the use of a Velcro™ strip or a strip of like hook and loop releasable fasteners to releasably attach a decorative ornamentation to the surface of a horse shoe shaped hair band without encasing the hair band.

Applicant is also aware of U.S. Pat. No. Des. 315,036 which issued Feb. 26, 1991 to Leopold for a Hair Band. The hair band consists of a toroidal shaped tube of fabric and containing within the tube, and running contiguously around the interior of the tube, a circle of elastic which acts to draw the tube together at the center so as to act as a hair elastic for holding a ponytail or like hair configuration. The circle of elastic is free floating within the tube.

SUMMARY OF THE INVENTION

With respect to the prior art decorative designs for use on horse shoe shaped hair bands, the prior art devices have considered different means for holding the decorative ornamentation in place.

The applicant's device is a removable hair band cover which may be used to decorate horse shoe shaped hair bands. The cover is comprised of an open ended tubular sleeve of material having, when the tube is laid out flat, one longitudinal elasticized seam. An elastic strip is sewn into the tube longitudinally to form the elasticized longitudinal seam. This seam causes the tubular sleeve to gather and thus naturally form a horse shoe shape so as to conform to the shape of the horse shoe shaped hair band over which the sleeve may be fitted. The sleeve may be of such a length as to completely cover the hair band or, alternatively, to leave the ends of the hair band protruding.

The hair band itself is a conventional horse shoe shaped resilient band possibly made of plastic or like resilient material, which may also have on either end a notch across its' width so as to mate with second and third elastic strips sewn into the ends of the sleeve so as to form elasticized cuffs.

The longitudinally elasticized sleeve holds the fabric tube into a rough pleating or gathering around its' lower or inner surface so that the top or outer surface of the tube, corresponding to the upper surface of the hair band, takes on an aesthetically pleasing ruffled appearance. The longitudinally elasticized seam acts to tension the fabric arid thus assists in holding the hair band cover in place. In particular, with the elasticized cuffs anchored at the ends of the hair band, the elasticized longitudinal seam tensions against those securing points thus tensioning the fabric of the cover not only around the width of the hair band but also longitudinally around the longitudinal circumference of the hair band. The longitudinal elasticized seam also assists in securing the hair band onto the head of the user because of the elasticized tension, and also provides an inner circumference of relatively densely packed fabric which acts to cushion the hair band against the head of the user thereby increasing the user's comfort when wearing such a device.

The hair band cover may thus be secured into place on a horse shoe shaped hair band and may be easily removed and replaced with a similarly constructed cover made of different material so as to give the hair band a different aesthetic appeal.

The removable cover for a hair band of the present invention thus comprises a fabric tube having first and second ends, the fabric tube having a longitudinally elasticized seam between the first and second ends whereby the cover is removably mountable on the hair band by sliding the fabric tube over the hair band so as to place the seam along an inside surface of the hair band.

The first and second ends of the hair band cover further have anchoring means for detachably securing the first and second ends to the hair band when the hair band cover is mounted on the hair band.

In one embodiment the anchoring means comprises first and second elasticized cuffs. The hair band has first and second ends notched to receive in releasable mating engagement the elasticized cuffs when the cover is mounted on the hair band.

In another embodiment the anchoring means comprises releasable fasteners on the first and second ends of the hair band, such as hook and loop fasteners or Velcro™ tabs, which receive in releasable mating engagement corresponding releasable fasteners on the first and second ends of the hair band cover.

DETAILED DESCRIPTION OF THE PREFERRED EMBODIMENTS

Figure 1:
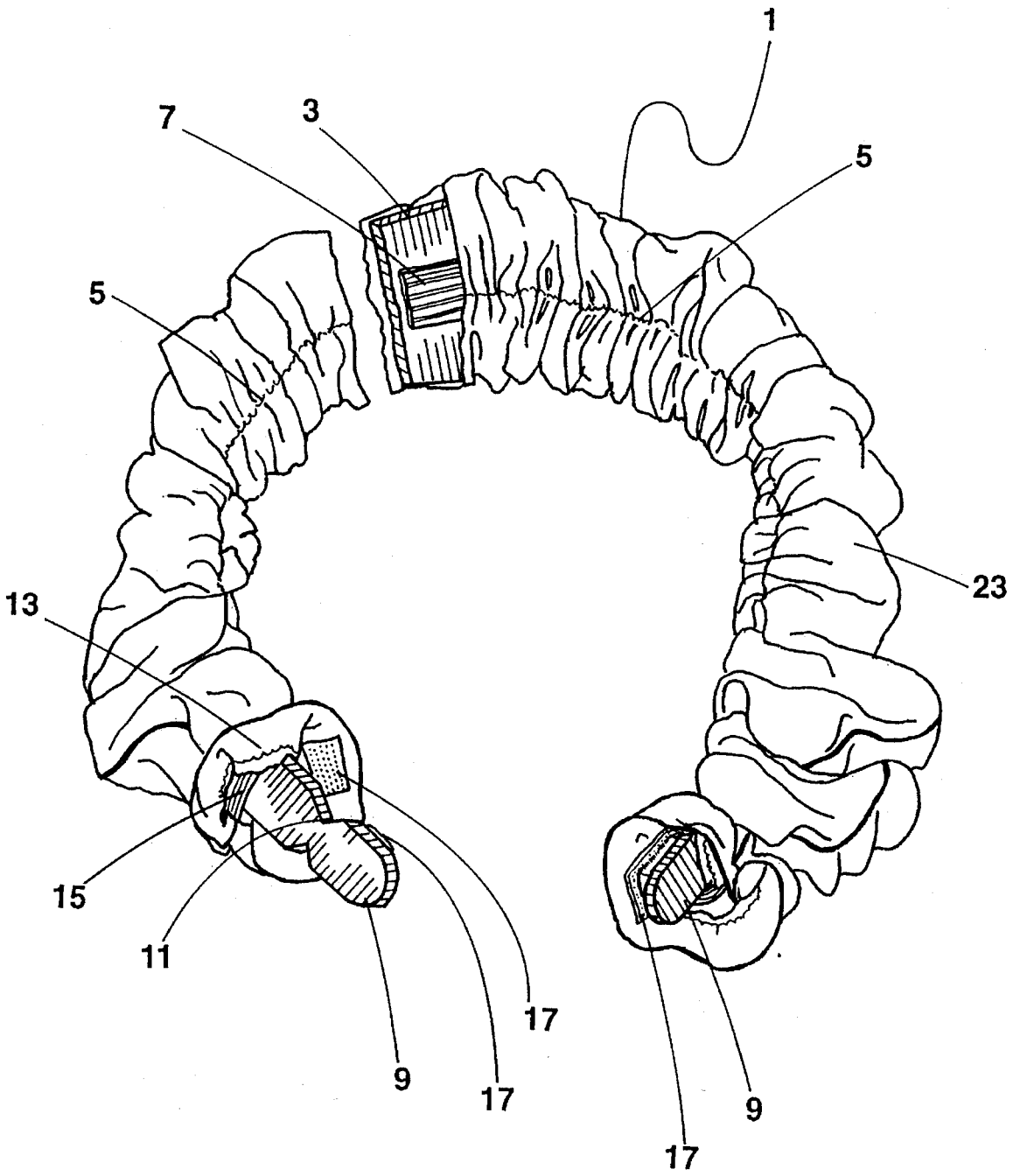
FIG. 1 is a partially cut away perspective view of the present invention.

FIG. 1 depicts tubular fabric sleeve 1 releasably mounted on flexible horse shoe shaped hair band 3. Sleeve 1 is a tube of fabric having a longitudinal seam 5. Sewn into the inner surface of sleeve 1 to form a longitudinally elasticized seam 5 is elastic strip 7 which acts to draw the fabric of sleeve 1 together along longitudinally elasticized seam 5 thereby causing sleeve 1 to deform into a horse shoe shape which conforms naturally to the horse shoe shape of hair band 3.

Hair band 3 has ends 9 which may be notched as by notches 11. Elasticized cuffs 13 may be formed in the ends of sleeve 1 by sewing in strips or circles of elastic 15.

Alternatively to elasticized cuffs 13, or in addition to elasticized cuffs 13, releasable fasteners such as snap fasteners (not shown) or Velcro™ tabs 17 may be used to releasably secure the ends of sleeve 1 to ends 9 of hair band 3.

Alternatively, notches 11 do not have to be provided, as, if sufficiently tight, elasticized cuffs 13 will releasably secure over the outermost ends of ends 9.

Figure 2:
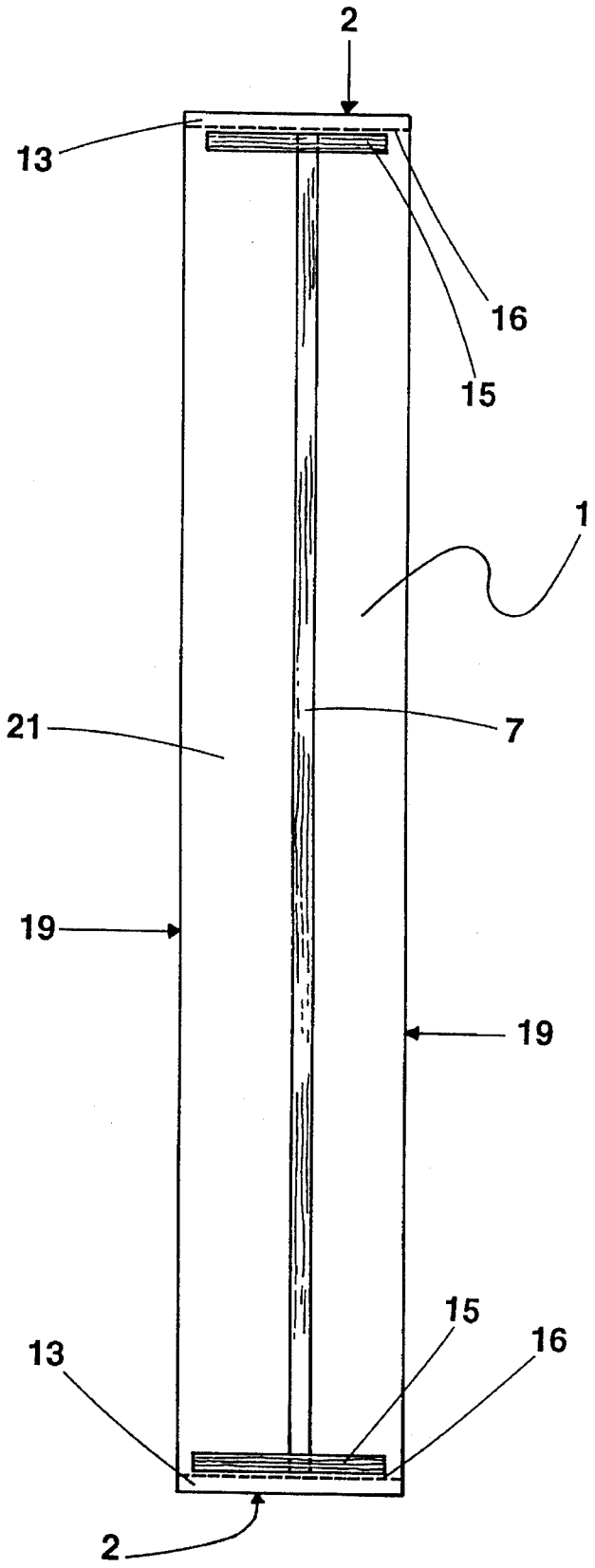
FIG. 2 is a plan view of the fabric, laid flat, of the fabric tube of FIG. 1.

With reference to FIG. 2, in manufacturing the removable hair band cover of the present invention, the following steps have been found advantageous:

1. Choose aesthetically pleasing material. Examples: For light weight material measure 32 inches in length, 5½ inches in width, and 13 inches of elastic. For heavy weight material measure 30 inches in length, 5½ inches in width, and 14 inches of elastic. All standard materials are 5½ inches in width.
2. Hem the material then measure ½ inch in from sleeve ends 2 between longitudinal edges 19 and fold toward the interior surface. Sew in place to form cuffs 13.
3. Measure and cut elastic strip 7 to desired length (13 or 14 inches). Position elastic strip 7 so end of elastic strip 7 is aligned with sewn edge of one cuff 13 and elastic strip 7 is centered between longitudinal edges 19 or along the length of one longitudinal edge 19.
4. Sew longitudinally along elastic strip 7 for ½ inch from cuff 13 with elastic lying loosely on fabric. Reserving ½ inch of elastic strip 7, stretch elastic strip 7 to lay flat to ½ inch from opposed cuff 13 so that elastic strip 7 is centered between longitudinal edges 19 or along one longitudinal edge 19, and sew in place, holding elastic stretched to lay flat as you sew. Sew last ½ inch of elastic strip 7 to remaining ½ inch of material at opposed cuff 13 with elastic strip 7 lying loosely on fabric.
5. Measure and cut two 2½ inch strips of cuff elastic 15. Place one strip of cuff elastic 15 horizontally between opposed longitudinal edges 19 so that outermost edge of cuff elastic 15 aligns with cuff edge 16 of cuff 13 and beginning ½ inch from one opposed longitudinal edge 19 sew ¼ inch with elastic lying loosely on fabric. Reserving ¼ inch of cuff elastic 15, stretch remaining cuff elastic 15 to fit to ¾ inches from opposed longitudinal edge 19 keeping outermost edge of cuff elastic 15 aligned along sewn edge of cuff 13 and sew in place, holding elastic stretched to lay flat as you sew and sewing over end of elastic strip 7 in center or along one longitudinal edge 19 of cuff elastic 15. Sew remaining ¼ inch of cuff elastic 15 in place lying loosely on fabric to ½ inch from opposed longitudinal edge 19.
6. Fold sleeve 1 in half longitudinally so that longitudinal edges 19 mate together leaving interior surface 21 exposed and enclosing exterior surface 23. Measure in 1 centimeter from longitudinal edges 19 and sew longitudinal edges 19 together starting from one sleeve end 2 and sewing over cuff 13, stretching sleeve 1 so the material lays flat for sewing. Measure in ½ centimeter from longitudinal edges 19 and sew longitudinal edges 19 together between cuffs 13, stretching sleeve 1 so the material lays flat for sewing. Measure in 1 centimeter from longitudinal edges 19 and sew longitudinal edges 19 together from opposed cuff 13 over opposed sleeve end 2, stretching sleeve 1 so the material lays flat for sewing.
7. Turn sleeve 1 exterior surface out by pulling one sleeve end 2 through sleeve 1 and out the opposite sleeve end 2 until sleeve 1 has been turned so that interior surface 21 is enclosed and exterior surface 23 is exposed.
8. Velcro™ tabs may be sewn into the interior of sleeve ends 2.
9. Mating corresponding tabs are glued onto ends 9 of hair band 3. A conventional hair band 3 may require notching proximate to ends 9 to form notches 11.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A hair band and removable cover comprising a fabric tube having first and second tube ends, a resilient horse-shoe shaped hair band, said fabric tube having a longitudinally elasticized seam between said first and second tube ends whereby said cover is removably mountable on said resilient horse-shoe shaped hair band by sliding said fabric tube over said hair band so as to place said seam along an inside surface of said hair band.

2. The hair band and cover of claim 1 wherein said first and second tube ends further comprise anchoring means for detachably securing said first and second tube ends to said hair band when said cover is mounted on said hair band.

3. The hair band and cover of claim 2 wherein said anchoring means comprises first and second elasticized cuffs.

4. The hair band and cover of claim 3 wherein said hair band has first and second band ends, said first and second band ends having notches therein for receiving, in releasable mating engagement, said elasticized cuffs when said cover is mounted on said hair band.

5. The hair band and cover of claim 2 wherein said hair band has first and second band ends and said anchoring means comprises releasable fasteners on said first and second band ends for releasably fastening said first and second tube ends to corresponding said first and second band ends.

6. A removable cover for a hair band comprising a fabric tube having first and second ends, said fabric tube having a longitudinally elasticized seam between said first and second ends whereby said cover is removably mountable on said hair band by sliding said fabric tube over said hair band so as to place said seam along an inside surface of said hair band, wherein said first and second ends further comprise anchoring means for detachably securing said first and second ends to said hair band when said cover is mounted on said hair band, and wherein said anchoring means comprises first and second elasticized cuffs.

* * * * *